US010468775B2

(12) United States Patent
Xiang et al.

(10) Patent No.: US 10,468,775 B2
(45) Date of Patent: Nov. 5, 2019

(54) ANTENNA ASSEMBLY, WIRELESS COMMUNICATIONS ELECTRONIC DEVICE AND REMOTE CONTROL HAVING THE SAME

(71) Applicant: AUTEL ROBOTICS CO., LTD., Shenzhen, Guangdong (CN)

(72) Inventors: Shengzhao Xiang, Guangdong (CN); Yiye Sun, Guangdong (CN); Zhuanpeng Cheng, Guangdong (CN)

(73) Assignee: AUTEL ROBOTICS CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/883,673

(22) Filed: Jan. 30, 2018

(65) Prior Publication Data

US 2018/0331430 A1 Nov. 15, 2018

Related U.S. Application Data

(63) Continuation of application No. PCT/CN2017/107379, filed on Oct. 23, 2017.

(30) Foreign Application Priority Data

May 12, 2017 (CN) ..... 2017 1 0335550

(51) Int. Cl.
*H01Q 13/10* (2006.01)
*H01Q 1/38* (2006.01)
(Continued)

(52) U.S. Cl.
CPC ..... *H01Q 13/106* (2013.01); *H01Q 1/38* (2013.01); *H01Q 9/0407* (2013.01);
(Continued)

(58) Field of Classification Search
CPC ..... H01Q 1/38; H01Q 1/085; H01Q 13/106; H01Q 13/08; H01Q 9/0407; H01Q 21/08
(Continued)

(56) References Cited

U.S. PATENT DOCUMENTS 6,181,281 B1 * 1/2001 Desclos ..... H01Q 1/38 343/700 MS
6,515,629 B1 * 2/2003 Kuo ..... H01Q 1/38 343/700 MS
(Continued)

FOREIGN PATENT DOCUMENTS

CN 101159351 A 4/2008
CN 201298596 Y 8/2009
(Continued)

OTHER PUBLICATIONS

International Search Report dated Feb. 13, 2018; PCT/CN2017/107379 *English Translation Is Not Yet Available From WIPO*.
(Continued)

*Primary Examiner* — Lam T Mai

(57) ABSTRACT

The present application relates to the field of communications, and provides an antenna assembly which is disposed in a wireless communications electronic device. The wireless communications electronic device is provided with a substrate. The antenna assembly includes: a radiation element, disposed at a first surface of the radiation element; a feeder, electrically connected to the radiation element; and a reference ground, disposed at a second surface of the substrate. The antenna assembly in the embodiments of the present application uses the substrate of the wireless communications electronic device as a medium to bear the radiation element, reducing space and costs of the antenna assembly; and because the substrate is relatively thick, a bandwidth of the antenna assembly is also increased. The
(Continued)

embodiments of the present application further provide a wireless communications electronic device having the antenna assembly.

19 Claims, 9 Drawing Sheets

(51) Int. Cl.
*H01Q 13/08* (2006.01)
*H01Q 9/04* (2006.01)
*H01Q 1/08* (2006.01)
*H01Q 21/08* (2006.01)

(52) U.S. Cl.
CPC ..... *H01Q 13/08* (2013.01); *H01Q 1/085* (2013.01); *H01Q 21/08* (2013.01)

(58) Field of Classification Search
USPC ..... 343/700 MS, 793
See application file for complete search history.

(56) References Cited

U.S. PATENT DOCUMENTS 6,999,029 B2 * 2/2006 Nakano ..... H01Q 1/38 343/700 MS
8,847,821 B2 * 9/2014 Murayanna ..... H01Q 1/243 343/700 MS
2004/0246182 A1 * 12/2004 Chen ..... H01Q 9/0442 343/700 MS
2005/0083233 A1 4/2005 He et al.
2008/0106473 A1 * 5/2008 Chung ..... H01Q 1/38 343/700 MS
2008/0252530 A1 * 10/2008 Bae ..... H01Q 1/2208 343/700 MS
2008/0272976 A1 * 11/2008 Kitamori ..... H01Q 9/285 343/793
2008/0316115 A1 12/2008 Hill et al.
2009/0213010 A1 * 8/2009 Chou ..... H01Q 9/0407 343/700 MS
2011/0260925 A1 * 10/2011 Chirila ..... H01Q 1/38 343/700 MS
2012/0127037 A1 * 5/2012 Fujiwara ..... H01Q 9/0407 343/700 MS
2013/0027268 A1 * 1/2013 Ohno ..... H01Q 9/285 343/818
2015/0364821 A1 * 12/2015 Tao ..... H01Q 5/307 343/848
2016/0028148 A1 1/2016 Tan et al.

FOREIGN PATENT DOCUMENTS

CN 102800957 A 11/2012
CN 204333248 U 5/2015
CN 205692364 U 11/2016
EP 0923156 A1 6/1999
WO 01/76006 A1 10/2001

OTHER PUBLICATIONS

Extended European Search Report dated Dec. 3, 2018; Appln. No. 17825095.7.

* cited by examiner

ANTENNA ASSEMBLY, WIRELESS COMMUNICATIONS ELECTRONIC DEVICE AND REMOTE CONTROL HAVING THE SAME

CROSS-REFERENCE

This application is a continuation application of International Application No. PCT/CN2017/107379, filed Oct. 23, 2017, which claims priority of Chinese Patent Application No. 201710335550.2, filed May 12, 2017, both of which are incorporated herein by reference in its entirety.

TECHNICAL FIELD

The present application relates to the field of communications, and in particular, to an antenna assembly, a wireless communications electronic device and a remote control having the same.

RELATED ART

An antenna which serves as an electronic device for transmitting or receiving radio waves is an indispensable element in the industry of communications. In order to adapt to the requirements on miniaturization of wireless communications electronic devices, miniaturization is becoming the trend of the development of antennas. At present, microstrip antennas used on the market has the advantages of miniaturization, ease of integration and good directionality, which makes the microstrip antennas widely used in the industry of communications.

The microstrip antenna is usually disposed on a thin dielectric substrate. One side is attached with a metal thin layer to serve as a ground plate and the other side is attached with a metal patch of a shape to serve as a radiation element. At the same time, a microstrip or a coaxial probe is used to feed for the patch, so as to form an entire microstrip antenna. At present, the microstrip antenna is installed at the wireless communications electronic device as an entire element. A portion of the microstrip antenna is disposed in the wireless communications electronic device and the other portion is exposed. However, this structure cannot completely satisfy the requirements on the miniaturization of the wireless communications electronic device. In addition, most existing microstrip antenna manufacturers select Rogers plates as the dielectric plates of the microstrip antennas, whose cost is relatively high. For example, the price of a microstrip antenna including two radiation elements and having an overall size of approximately 50×100 mm is usually about fifty RMB. As a result, the total costs of the wireless communications electronic device are increased.

SUMMARY

To resolve the foregoing technical problem, the embodiments of the present application provide a miniaturized and low-cost internal antenna assembly and a wireless communications electronic device having the same.

To resolve the foregoing technical problem, the embodiments of the present application provide the following technical solutions:

An antenna assembly is provided, which is disposed in a wireless communications electronic device, the wireless communications electronic device being provided with a substrate, where the antenna assembly includes: a radiation element, disposed at a first surface of the radiation element; a feeder, electrically connected to the radiation element; and a reference ground, disposed at a second surface of the substrate.

In some embodiments, the antenna assembly further includes a coaxial cable and the coaxial cable includes an inner core and an outer core, the inner core being connected to the feeder and the outer core being connected to the reference ground.

In some embodiments, the antenna assembly further includes a metal connector, the outer core of the coaxial cable being electrically connected to the reference ground by using the metal connector.

In some embodiments, the metal connector is a bent flexible circuit board, which includes a first connection end and a second connection end. The first connection end is connected to the outer core of the coaxial cable and is disposed at the first surface and the second connection end is connected to the reference ground and is disposed at the second surface.

In some embodiments, both the radiation element and the feeder are made of metals.

In some embodiments, there are at least two radiation elements.

In some embodiments, the feeder includes a microstrip feeder and at least two power division microstrips, and the number of the power division microstrips is equal to that of the radiation elements, one end of each of the power division microstrips being connected to a corresponding radiation element, and the other end of each of the power division microstrips being connected to the microstrip feeder.

In some embodiments, input powers obtained by the radiation elements from the feeder are equal.

In some embodiments, lengths of the at least two power division microstrips are equal.

In some embodiments, the substrate of the wireless communications electronic device is a plastic board configured to fix a display device of the wireless communications electronic device.

In some embodiments, the antenna assembly is a microstrip antenna.

To resolve the foregoing technical problem, the embodiments of the present application further provide the following technical solutions:

A wireless communications electronic device is provided, including: a substrate, including a first surface and a second surface; a radiation element, disposed at the first surface; a feeder, electrically connected to the radiation element; and a reference ground, disposed at the second surface.

In some embodiments, the wireless communications electronic device further includes a display device, where the display device includes a screen and a metal member; and the metal member is disposed at the second surface and serves as the reference ground.

In some embodiments, the wireless communications electronic device further includes a coaxial cable; and the coaxial cable includes an inner core and an outer core, the inner core being connected to the feeder and the outer core being connected to the reference ground.

In some embodiments, the wireless communications electronic device further includes a metal connector, the outer core of the coaxial cable being electrically connected to the reference ground by using the metal connector.

In some embodiments, the metal connector is a bent flexible circuit board, which includes a first connection end and a second connection end. The first connection end is connected to the outer core of the coaxial cable and is disposed at the first surface and the second connection end is connected to the reference ground and is disposed at the second surface.

In some embodiments, both the radiation element and the feeder are made of metals.

In some embodiments, there are at least two radiation elements.

In some embodiments, the feeder includes a microstrip feeder and at least two power division microstrips, and the number of the power division microstrips is equal to that of the radiation elements, one end of each of the power division microstrips being connected to a corresponding radiation element, and the other end of each of the power division microstrips being connected to the microstrip feeder.

In some embodiments, input powers obtained by the radiation elements from the feeder are equal.

In some embodiments, lengths of the at least two power division microstrips are equal.

In some embodiments, the substrate of the wireless communications electronic device is a plastic board configured to fix a display device of the wireless communications electronic device.

To resolve the foregoing technical problem, the embodiments of the present application further provide the following technical solutions:

A wireless communications electronic device is provided, including the antenna assembly stated above.

In some embodiments, the wireless communications electronic device includes a display device, where the display device includes a screen and a substrate and the reference ground is disposed at a backside of the screen and the substrate is an insulation board fixing the screen.

To resolve the foregoing technical problem, the embodiments of the present application further provide the following technical solutions:

A remote control is provided, including:

a remote control body and a display, connected to the remote control body, where the display includes a screen, a substrate fixing the screen and an antenna assembly installed at the substrate; and the antenna assembly is the antenna assembly stated above.

In some embodiments, the remote control is configured to control a movable object.

Compared with the prior art, the antenna assembly in the embodiments of the present application uses the substrate of the wireless communications electronic device as a medium to bear the radiation element, replacing a plastic material (for example, the Rogers plates introduced in the background) which is used as the antenna assembly in the prior art, so that space occupied by the antenna assembly is reduced and costs of the antenna assembly are also saved. Because the substrate is relatively thick, a bandwidth of the antenna assembly is also increased.

In addition, space of the antenna assembly is significantly saved by using the metal member of the wireless communications electronic device as the reference ground of the antenna assembly. Moreover, the antenna assembly has a stable performance and relatively strong directionality because the reference ground of the antenna assembly is very large, thereby achieving a high gain of the antenna assembly.

In addition, the antenna assembly in the embodiments of the present application is completely built in the wireless communications electronic device, so that requirements on miniaturization of the wireless communications electronic device may be satisfied.

BRIEF DESCRIPTION OF THE DRAWINGS

One or more embodiments are exemplarily described by using the figures in the corresponding accompany drawings. The exemplary descriptions do not constitute limitations to the embodiments. Elements having a same reference digital number in the accompany drawings represent similar elements, and unless indicated otherwise, the figures in the accompany drawings do not constitute proportion limitations.

DETAILED DESCRIPTION

For ease of understanding the present application, the present application is described in further detail below with reference to the accompanying drawings and specific implementations. It should be noted that when an element is described as being "fixed" on another element, the element may be directly on the another element, or one or more intermediate elements may exist therebetween. When an element is described as being "connected" to another element, the element may be directly connected to the another element, or one or more intermediate elements may exist therebetween. Terms such as "perpendicular", "horizontal", "left", and "right" and similar expressions used in this specification are merely used for the purpose of description.

Unless otherwise defined, meanings of all technical and scientific terms used in this specification are the same as that usually understood by persons skilled in the technical field to which the present application belongs. The terms used in this specification of the present application are merely intended to describe specific implementations rather than limit the present application. A term "and/or" used in this specification includes any or all combinations of one or more related listed items.

Figure 1:
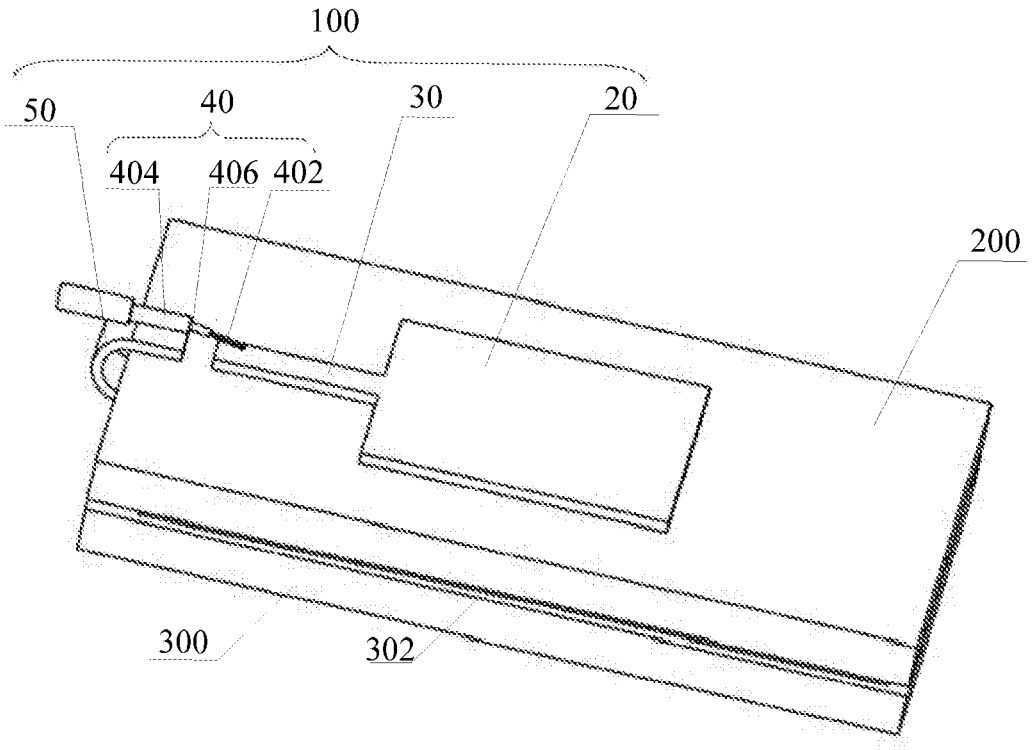
FIG. 1 is a schematic structural diagram of an antenna assembly provided in an embodiment of the present application, where the antenna assembly is installed at a substrate of a wireless communications electronic device.
Figure 2:
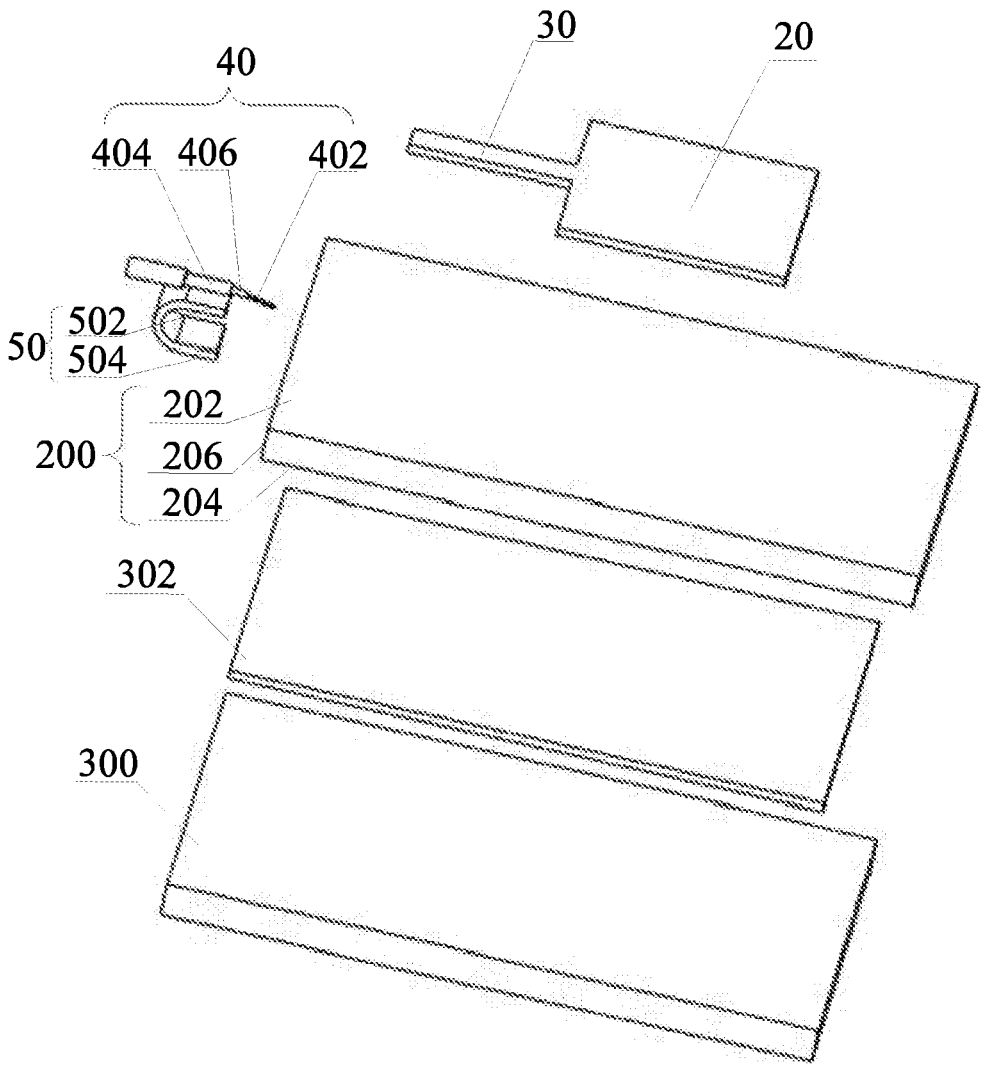
FIG. 2 is an exploded schematic diagram of the antenna assembly shown in FIG. 1.
Figure 3:
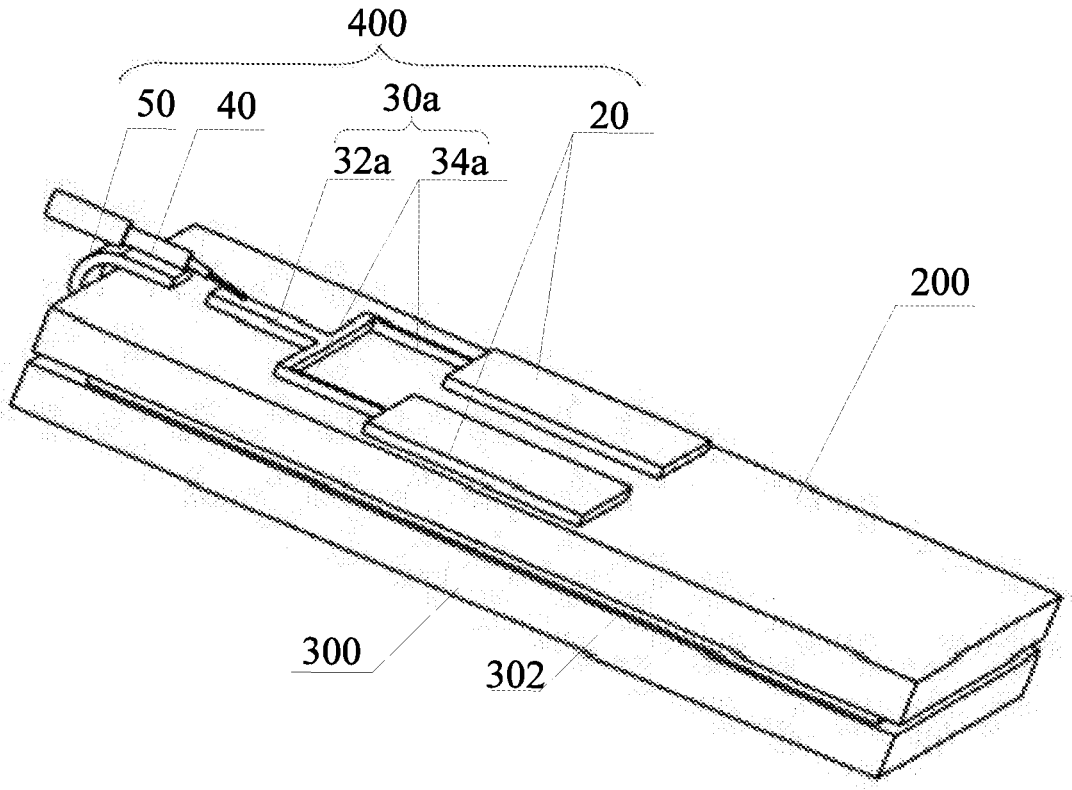
FIG. 3 is a schematic structural diagram of an antenna assembly provided in another embodiment of the present application, where the antenna assembly is installed at a substrate of a wireless communications electronic device.
Figure 4:
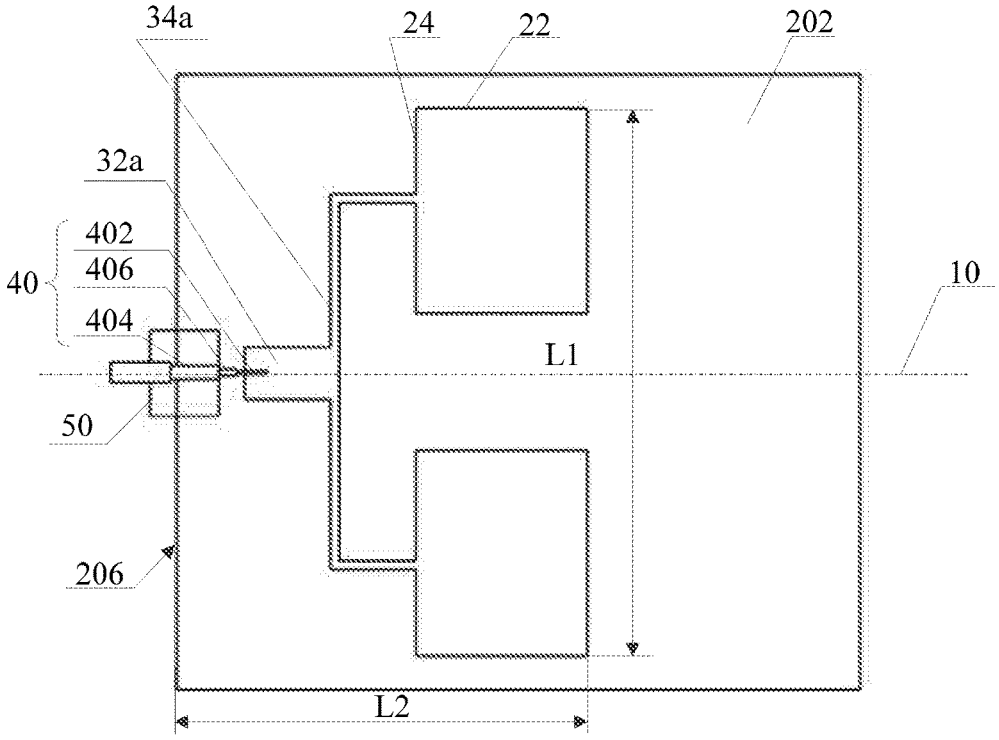
FIG. 4 is a schematic top view of the antenna assembly shown in FIG. 3.
Figure 5:
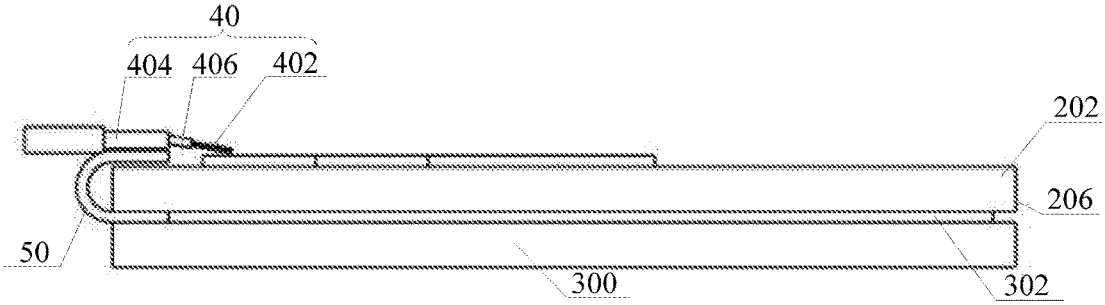
FIG. 5 is a schematic side view of the antenna assembly shown in FIG. 3.
Figure 6:
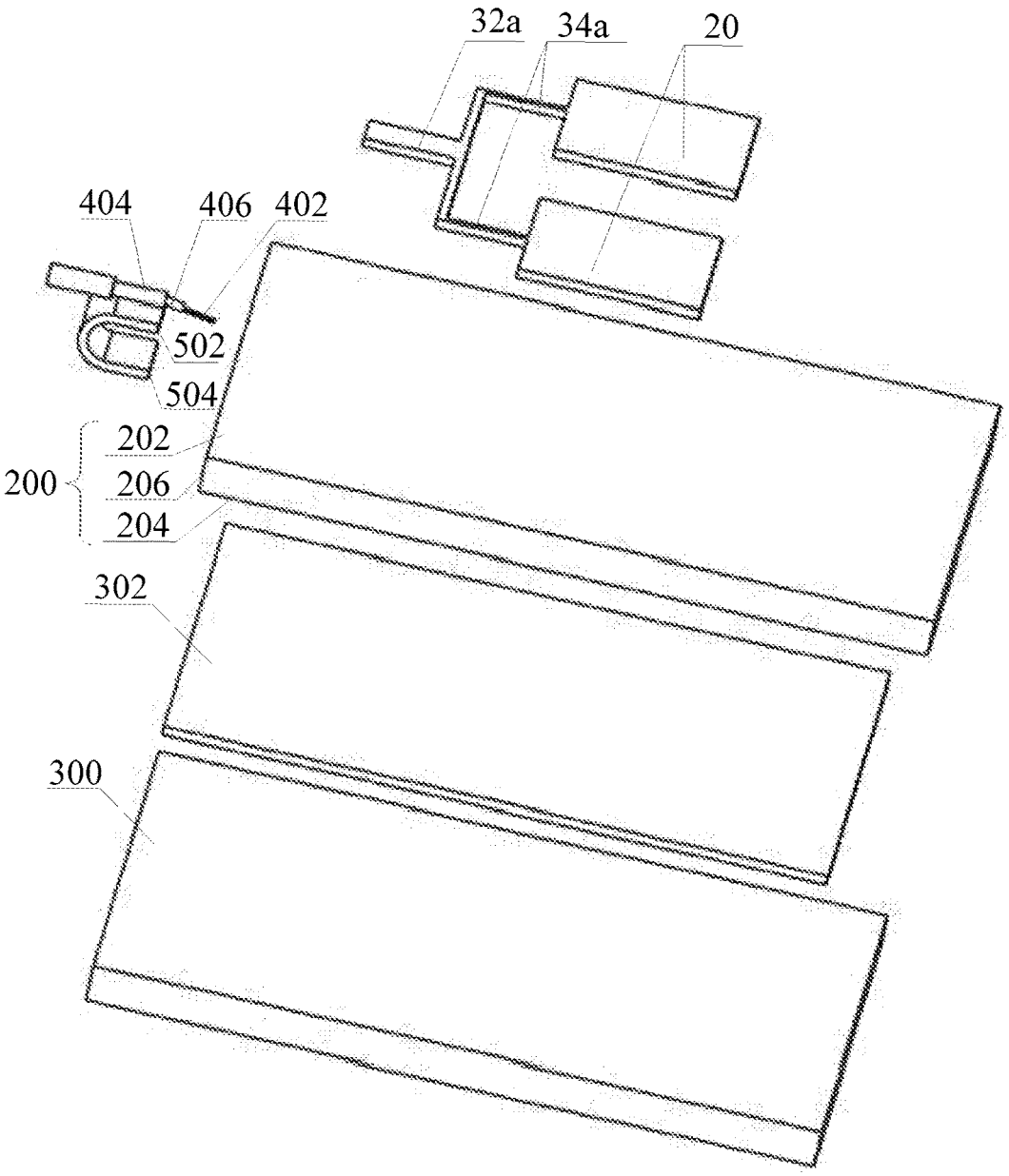
FIG. 6 is an exploded schematic diagram of the antenna assembly shown in FIG. 3.

Referring to FIG. 1 and FIG. 2, an antenna assembly 100 provided in an embodiment of the present application is shown, which is installed in a wireless communications electronic device. The wireless communications electronic device includes a substrate 200 and a display device having a screen 300. A metal member 302 is disposed at a backside of the screen 300. The metal member 302 is used as a shielding board in the wireless communications electronic device for shielding the screen 300, so as to prevent the screen 300 of the display device from being interfered by other electronic elements in the wireless communications electronic device. The wireless communications electronic device may be a mobile phone, a tablet or another wireless communications electronic device carrying a display device, for example, a drone remote control carrying a display device.

The substrate 200 is an insulation media, which may be a plastic board such as a Polycarbonate (PC) board. A thickness of the substrate 200 is 3.15 mm. The substrate 200 includes a first surface 202, a second surface 204 and an end surface 206 (see FIG. 2). The end surface 206 is connected between the first surface 202 and the second surface 204. The first surface 202 and the second surface 204 are disposed at two opposite sides of the substrate 200. In this embodiment, the substrate 200 is disposed in the wireless communications electronic device, being configured to fix or reinforce the display device. Especially, rigidity is smaller when the screen 300 is larger. Usually the substrate 200 needs to be set to fix the display device.

It may be understood that in some other embodiments, the substrate 200 may be any other insulation component in the wireless communications electronic device, for example, may be a front housing or a rear housing in the wireless communications electronic device for accommodating the screen 300.

The antenna assembly 100 is a microstrip antenna, including a radiation element 20, a feeder 30 and a coaxial cable 40. The radiation element 20, serving as a radiation portion of the antenna assembly 100, is configured to receive and transmit signals. In this embodiment of the present application, the feeder 30 is a feeding microstrip matching impedance of the coaxial cable 40. The feeder 30 takes a function of a matching circuit used for impedance matching. The radiation element 20 and the feeder 30 are disposed at the first surface 202 of the substrate 200. One end of the feeder 30 is electrically connected to the radiation element 20 and the other end is connected to the coaxial cable 40, so that the antenna assembly 100 is grounded by using the coaxial cable 40 and the feeder 30 is connected to a peripheral circuit by using the coaxial cable 40. Details are described in the following.

The metal member 302 is disposed at the second surface 204 of the substrate 200, to serve as the reference ground of the antenna assembly 100. The metal member 302 is a component originally disposed in the wireless communications electronic device to serve as the shielding board. Moreover, in this embodiment of the present application, the metal member 302 is further used as the reference ground of the antenna assembly 100. Therefore, there is no need to dispose an additional individual reference ground for the antenna assembly 100, so that costs are saved and space is also saved.

In this embodiment, there is one radiation element 20, which is a rectangular metal sheet and may be formed on the first surface 202 of the substrate 200 by using a photo-etch method. Alternatively, the radiation element 20 is first made into a metal sheet and then is fixed on the first surface 202 of the substrate 200. A working frequency of the antenna assembly 100 is determined by a size of the radiation element 20. It may be understood that in some other embodiments, the size f the radiation element 20 may be correspondingly changed according to different requirements. Similarly, the radiation element 20 is not limited to a rectangle shape and may also adopt other shapes, such as a circle, an ellipse, a ring or a hexagon.

In this embodiment, the feeder 30 is a rectangular metal sheet and may be formed on the first surface 202 of the substrate 200 by using the photo-etch method. Alternatively, the radiation element 20 is first made into a metal sheet and then is fixed on the first surface 202 of the substrate 200. It may be understood that in some other embodiments, the feeder 30 is not limited to be a metal sheet or is not limited to be disposed at the first surface 202, and may change correspondingly according to different feeding manners.

As stated above, one end of the feeder 30 is connected to the coaxial cable 40, so that the antenna assembly 100 is grounded by using the coaxial cable 40. Specifically, a transparent film insulation layer 406, a braided layer and an outer shield at one end of the coaxial cable 40 are stripped, so as to obtain an exposed inner core 402 and an exposed outer core 404. The transparent film insulation layer 406 is disposed between the inner core 402 and the outer core 404. The exposed inner core 402 is welded to one end of the feeder 30 which is far away from the radiation element 20, so as to be electrically connected to the radiation element 20 and may achieve impedance matching of 50 ohms with the feeder 30 at the same time. The exposed outer core 404 is connected to the metal member 302 which serves as the reference ground. The antenna assembly 100 further includes a metal connector. The metal connector is configured to electrically connect a ground end of the coaxial cable 40, that is, the exposed outer core 404 of the coaxial cable 40, to the reference ground. Therefore, feeding to the entire antenna assembly 100 is implemented.

In this embodiment, the metal connector is a flexible circuit board 50. One end of the flexible circuit board 50 is connected to the ground end, that is, the outer core 404, of the coaxial cable 40 and the other end is connected to the metal member 302 which serves as the reference ground, so that the ground end of the coaxial cable 40 is connected to the reference ground. The inner core 402 of the coaxial cable 40 is connected to the radiation element 20 of the feeder 30. The outer core 404 of the coaxial cable 40 is welded to the flexible circuit board 50, so that the entire antenna assembly 100 is connected to the reference ground by using the flexible circuit board 50. In addition, the feeder 30 is connected to the peripheral circuit by using the inner core 402 of the coaxial cable 40. The exposed outer core 404 is welded to the flexible circuit board 50. Moreover, the flexible circuit board 50 is connected to the peripheral circuit by using the outer core 404 of the coaxial cable 40. The peripheral circuit is, for example, a radio frequency circuit on a PCB board. The radio frequency circuit works after being powered on and sends signals to the radiation element 20 of the antenna assembly 100 by using the coaxial cable. The radiation element 20 then radiates these signals into the air to transmit.

The flexible circuit board 50 is bent and close to the end surface 206 of the substrate 200. Selecting a bent flexible circuit board 50 is to connect, by using the flexible circuit board 50, the radiation element 20 which is disposed at the first surface 202 of the substrate 200 to the metal member 302 which is disposed at the second surface 204 of the substrate 200. That is, the antenna assembly 100 is grounded by using the flexible circuit board 50. Specifically, the flexible circuit board 50 includes a first connection end 502 and a second connection end 504. The first connection end 502 is disposed at the first surface 202 and is separated from the feeder 30 by a preset distance. The exposed outer core 404 of the coaxial cable 40 is welded to the first connection end 502. The second connection end 504 is disposed at the second surface 204 and is electrically connected to the metal member 302. In some other embodiments, the flexible circuit board 50 may be omitted, but the entire antenna assembly 100 is grounded by using another metal connector, for example, a metal conducting wire. Alternatively, the antenna assembly 100 may be grounded by adopting other connection manners. For example, the antenna assembly 100 may be directly grounded by using the coaxial cable 40 or a ground end of the radiation element 20 of the antenna assembly 100 is directly prolonged, being laminated to be grounded. In addition, the feeder 30 may be electrically connected to the peripheral circuit by using another metal connector such as the metal conducting wire or adopt other connection manners. Similarly, the metal member 302 may also be electrically connected to the peripheral circuit by using another metal connector such as the metal conducting wire or adopt other connection manners.

In this embodiment of the present application, the metal member 302 disposed at the backside of the screen 300 is a metal board and is a shielding board configured to shield the screen 300. To prevent the screen of the display device from being interfered by other electronic elements in the wireless communications electronic device, such a shielding board is usually disposed to shield and protect the screen. In this embodiment, the shielding board which originally exists on the display device of the wireless communications electronic device is used as the reference ground of the antenna assembly 100, thereby saving space of the antenna assembly 100. It may be understood that in some other embodiments of the present application, the metal member 302 which serves as the reference ground of the antenna assembly 100 may not be used. But a component made of any other metal material in the wireless communications electronic device may be adopted to serve as the reference ground of the antenna assembly 100. For example, if an outer frame of a display screen of the wireless communications electronic device is made of a metal material, the outer frame made of the metal material may be used as the reference ground of the antenna assembly 100.

Referring to FIG. 3 to FIG. 6, an antenna assembly 400 provided in another embodiment of the present application is shown. The antenna assembly 400 in this embodiment is substantially same to the antenna assembly 100 provided in the foregoing embodiment. The difference is that: the antenna assembly 400 provided in this embodiment includes two radiation elements 20 which are electrically connected to the coaxial cable 40 by using a feeder 30*a*.

Each radiation element 20 is a rectangular metal sheet. The two radiation elements 20 are separated from each other by a preset distance and are symmetrically disposed at two sides of a symmetry axis 10. In this embodiment, a size of each radiation element 20 is 48 mm×43 mm. In some other embodiments, the radiation elements 20 may have different sizes. Each radiation element 20 includes two parallel first side edges 22 and two parallel second side edges 24. The first side edges 22 are vertical to the second side edges 24. The first side edges 22 of each radiation element 20 are parallel to those of the other radiation element 20. Similarly, the second side edges 24 of each radiation element 20 are parallel to those of the other radiation element 20.

The feeder 30*a* includes a microstrip feeder 32*a* and a power division microstrip 34*a*. There are two power division microstrips 34*a*. An input end of each power division microstrip 34*a* is connected to the microstrip feeder 32*a*. Output ends of the power division microstrips 34*a* are separately connected to one radiation element 20. In this embodiment, the two power division microstrips 34*a* are equal power division microstrips. That is, the two power division microstrips 34*a* have a same shape and an equal size. Each power division microstrip 34*a* is "L" shaped, one end thereof being connected to an intermediate portion of one second side edge 24 and the other end being connected to one end of the microstrip feeder 32*a*. The two equal power division microstrips 34*a* are symmetrically disposed at the two sides of the symmetry axis 10. In this embodiment, input powers of the two radiation elements 20 are equally divided by the two equal power division microstrips 34*a*. Therefore, the input powers of the two radiation elements 20 are equal. In some other embodiments, each power division microstrip 34*a* may be in a straight line, one end thereof being connected to the intermediate portion of one second side edge 24 and the other end being connected to one end of the microstrip feeder 32*a*. The two power division microstrip 34*a* in straight lines are symmetrically disposed at the two sides of the symmetry axis 10. It should be understood that in some other embodiments, lengths of the two power division microstrips 34*a* may not be equal. And/or the input powers obtained by the radiation elements 20 from the feeder 30*a* may not be equal.

The microstrip feeder 32*a* is disposed along the symmetry axis 10 and one end thereof is connected to the two power division microstrips 34*a*. The power division microstrips 34*a* and the microstrip feeder 32*a* are metal sheets and are disposed at the first surface 202 of the substrate 200 together with the radiation element 20. The radiation element 20, the power division microstrips 34*a* and the microstrip feeder 32*a* have thicknesses of 0.035 mm and may be formed on the first surface 202 of the substrate 200 by using a photo-etch method. Alternatively, the radiation element 20 is fixed the same on the first surface 202 of the substrate 200 after the power division microstrips 34*a* and the microstrip feeder 32*a* are made into metal sheets. It may be understood that in some other embodiments, the feeder 30*a* is not limited to be a metal sheet or is not limited to be disposed at the first surface 202, and may change correspondingly according to different feeding manners.

A working frequency of the antenna assembly 400 is determined by a size of each radiation element 20. A gain of the antenna assembly 400 is determined by a distance between the two radiation elements 20. Impedance matching of the antenna assembly 400 is basically determined by sizes of the power division microstrips 34*a* and the microstrip feeder 32*a*. In this embodiment, each radiation element 20 is rectangular and has a size of 48 mm×43 mm. A distance L1 between the first side edge 22 of each radiation element 20 which is far away from the symmetry axis 10 and the first side edge 22 of the other radiation element 20 which is far away from the symmetry axis 10 is 100 mm. A distance L2 between the second side edge 24 of each radiation element 20 which is far away from the microstrip feeder 32*a* and the end surface 206 of the substrate 200 is 80 mm. The power division microstrip 34*a* and the microstrip feeder 32*a* may achieve impedance matching of 50 ohms.

Figure 7:
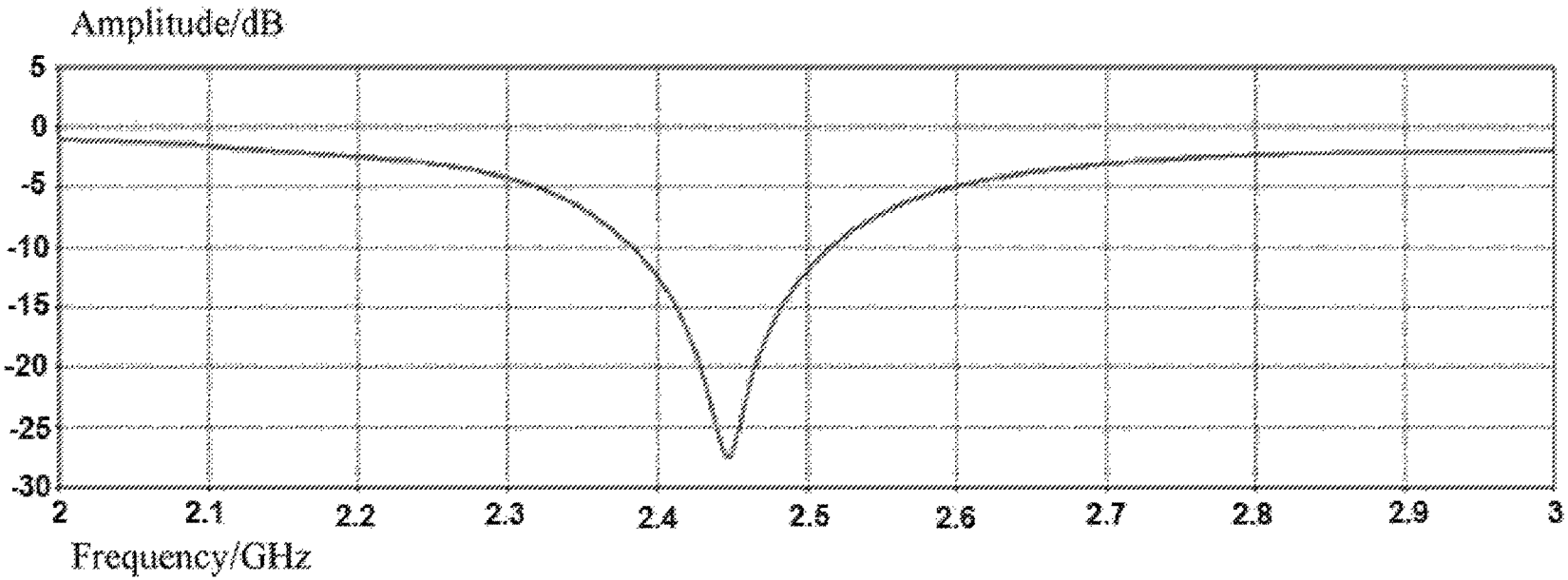
FIG. 7 is a diagram of a parameter S of the antenna assembly shown in FIG. 3 to FIG. 6.

Referring to FIG. 7, an antenna assembly 400 in this embodiment may work at a range of 2.38-2.51 GHz and has a bandwidth of 130 MHz, covering a common frequency band of 2.45 GHz.

Figure 8:
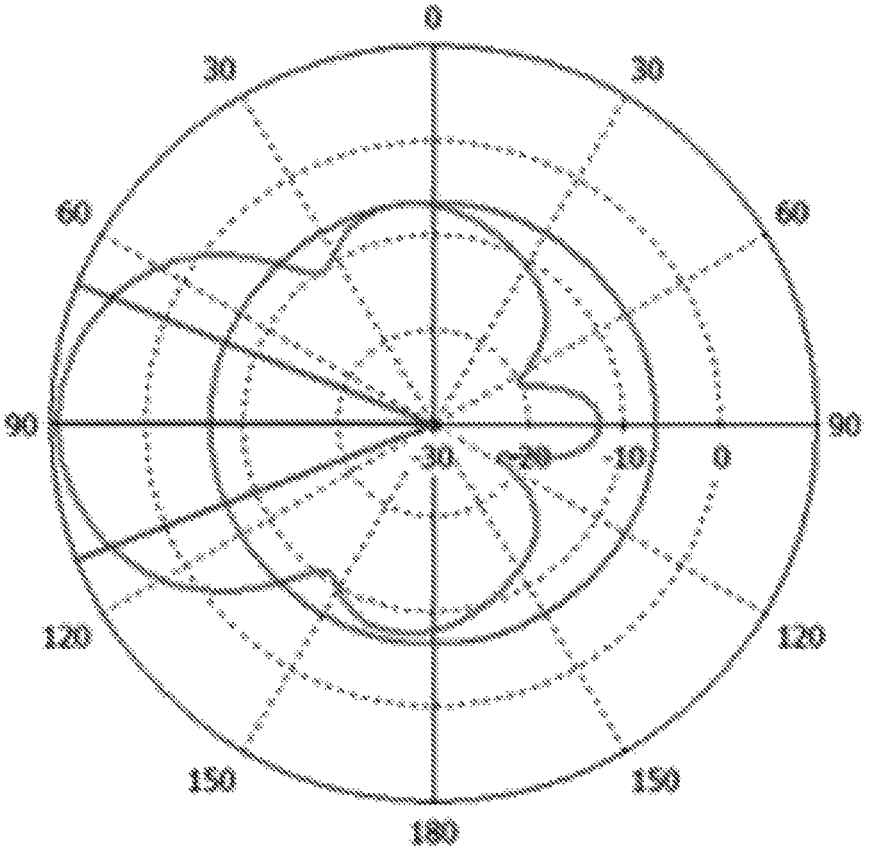
FIG. 8 is an E-plane pattern of the antenna assembly shown in FIG. 3 to FIG. 6 which is radiated at 2.45 GHz.
Figure 9:
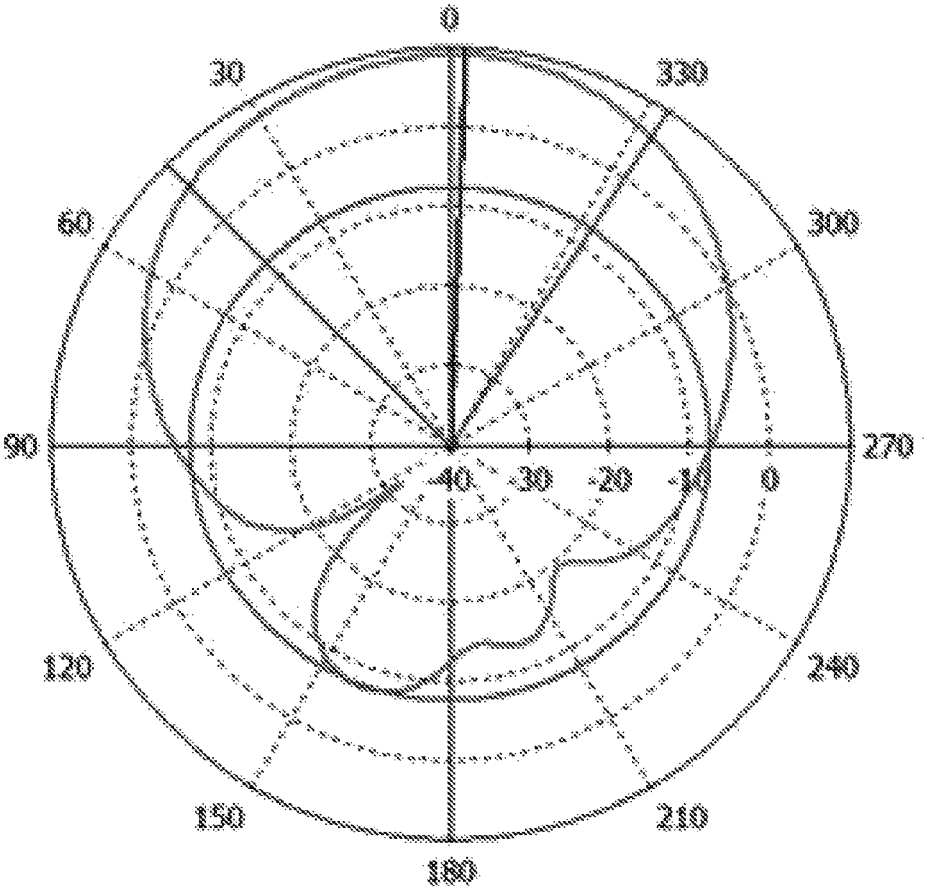
FIG. 9 is an H-plane pattern of the antenna assembly shown in FIG. 3 to FIG. 6 which is radiated at 2.45 GHz.

Referring to FIG. 8 and FIG. 9, FIG. 8 is an E-plane pattern of the antenna assembly 400 in this embodiment shown in FIG. 3 to FIG. 6 which is radiated at 2.45 GHz; and FIG. 9 is an H-plane pattern of the antenna assembly 400 in this embodiment shown in FIG. 3 to FIG. 6 which is radiated at 2.45 GHz. The antenna assembly 400 in this embodiment is a directional antenna and a gain thereof may reach 9 dBi.

A remote control is used as an example in the following to describe the technical features of a wireless communications electronic device in the embodiments of the present application.

Figure 10:
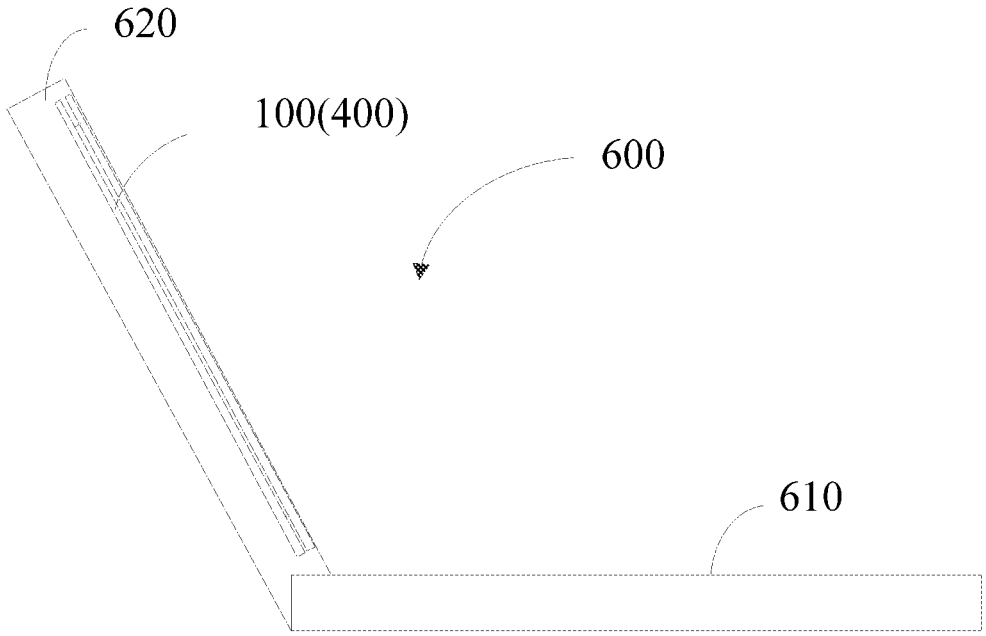
FIG. 10 is a schematic structural diagram of a wireless communications electronic device provided in still another embodiment of the present application.

Referring to FIG. 10, an embodiment of the present application provides a remote control 600*a* which is configured to control a movable object. The remote control 600 includes a remote control body 610 and a display 620. One end of the display 620 is pivotally connected to the remote control body 610. When the remote control 600 is used, the display 620 is pivoted from an off state to an on state.

The display 620 includes a screen, a substrate fixing the screen and an antenna assembly installed at the substrate.

Preferably, the antenna assembly in the display 620 is the antenna assemblies 100 and 400 in the foregoing embodiments.

Preferably, the movable object is an unmanned aerial vehicle (UAV).

It should be understood that wireless communications electronic device in this embodiment of the present application is not limited to be a remote control and may further be a mobile phone, a tablet or another wireless communications electronic device carrying a display device.

A person skilled in the art should understand that to obtain the antenna assembly 400 of different performances and uses, the sizes, the shapes and the quantity of the radiation elements 20 and the distance between the two radiation elements 20 may be changed. And the sizes and relative positions of the power division microstrip 34*a* and the microstrip feeder 32*a* may also be changed. The radiation element 20 and the power division microstrip 34*a* are not limited to be symmetrically disposed at two sides of the symmetry axis 10. The microstrip feeder 32*a* is not limited to be disposed along the symmetry axis 10. Relative positions of the radiation element 20, the power division microstrip 34*a* and the microstrip feeder 32*a* may be changed according to actual requirements.

For example, the radiation element 20 in this embodiment is rectangular and may adopt other shapes in some other embodiments, such as a square, a circle, an ellipse, a ring, and a hexagon. In addition, there are two radiation elements 20 in this embodiment. However, in some other embodiments, an antenna matrix may be formed by using multiple radiation elements such as four radiation elements 20 or six radiation elements 20.

The antenna assemblies 100 and 400 in this embodiment of the present application uses the substrate 200 of the wireless communications electronic device as a medium to bear the radiation element 20, replacing a plastic material (for example, the Rogers plates introduced in the background) which is used as the antenna assembly in the prior art, so that space occupied by the antenna assemblies 100 and 400 is reduced. Compared with the antenna assembly in the prior are which has the same size, the Rogers plate is omitted and a component which originally exists in the wireless communications electronic device and is for fixing or reinforcing the display device is used as media of the antenna assemblies 100 and 400, so that merely the radiation element and a much thin patch of the feeder are remained to the antenna assemblies 100 and 400 in the embodiments of the present application. A selling price is merely about ten Yuan, saving the costs of the antenna assemblies 100 and 400. The substrate 200 is relatively thick, also increasing bandwidths of the antenna assemblies 100 and 400.

Moreover, the antenna assemblies 100 and 400 in the embodiments of the present application use a back-surface metal member 302 of the screen 300 of the display device as the reference ground of the antenna assemblies 100 and 400, thereby saving the space of the antenna assemblies 100 and 400. Moreover, because the metal member 302 which serves as the reference ground is relatively large, the antenna assemblies 100 and 400 have stable performances and strong directionality, thereby achieving high gains of the antenna assemblies 100 and 400.

In addition, the antenna assembly 100 and 400 in this embodiment are completely built in the wireless communications electronic device, for example, are applied to the remote control, so that requirements on miniaturization of the wireless communications electronic device may be satisfied.

Finally, it should be noted that the foregoing embodiments are merely intended for describing the technical solutions of the present application, but not for limiting the present application. Although under the idea of the present application, technical features of the foregoing embodiments or different embodiments may be combined, steps may be implemented in any sequence, and many other changes of different aspects of the present application exist. For brevity, they are not provided in details. Although the present application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present application.

What is claimed is:

1. An antenna assembly, disposed in a wireless communications electronic device, the wireless communications electronic device being provided with a substrate, wherein the antenna assembly comprises:

a radiation element disposed at a first surface of the substrate;

a feeder electrically connected to the radiation element; and a reference ground disposed at a second surface of the substrate;

wherein the antenna assembly comprises at least two radiation elements;

wherein the feeder comprises a microstrip feeder and at least two power division microstrips, and the number of the power division microstrips is equal to that of the radiation elements;

wherein one end of each of the power division microstrips is connected to a corresponding radiation element, and the other end of the each of the power division microstrips is connected to the microstrip feeder.

2. The antenna assembly according to claim 1, wherein the antenna assembly further comprises a coaxial cable; the coaxial cable comprising an inner core and an outer core, the inner core being connected to the feeder and the outer core being connected to the reference ground.

3. The antenna assembly according to claim 2, wherein the antenna assembly further comprises a metal connector, the outer core of the coaxial cable being electrically connected to the reference ground by using the metal connector.

4. The antenna assembly according to claim 3, wherein the metal connector is a bent flexible circuit board, and the flexible circuit board comprises a first connection end and a second connection end, the first connection end being connected to the outer core of the coaxial cable and disposed at the first surface, the second connection end being connected to the reference ground and disposed at the second surface.

5. The antenna assembly according to claim 1, wherein input powers obtained by the radiation elements from the feeder are equal.

6. The antenna assembly according to claim 1, wherein lengths of the at least two power division microstrips are equal.

7. The antenna assembly according to claim 1, wherein the substrate of the wireless communications electronic device is a plastic board configured to fix a display device of the wireless communications electronic device.

8. The antenna assembly according to claim 1, wherein the antenna assembly is a microstrip antenna.

9. A wireless communications electronic device, comprising:

a substrate comprising a first surface and a second surface;

a radiation element disposed at the first surface;

a feeder electrically connected to the radiation element; and a reference ground disposed at the second surface;

wherein the wireless communications electronic device comprises at least two radiation elements;

wherein the feeder comprises a microstrip feeder and at least two power division microstrips, and the number of the power division microstrips is equal to that of the radiation elements;

wherein one end of each of the power division microstrips is connected to a corresponding radiation element, and the other end of the each of the power division microstrips is connected to the microstrip feeder.

10. The wireless communications electronic device according to claim 9, further comprising a display device, wherein the display device comprises a screen and a metal member, the metal member being disposed at the second surface and serves as the reference ground.

11. The wireless communications electronic device according to claim 9, wherein the wireless communications electronic device further comprises a coaxial cable;

wherein the coaxial cable comprises an inner core and an outer core, the inner core being connected to the feeder and the outer core being connected to the reference ground.

12. The wireless communications electronic device according to claim 11, wherein the wireless communications electronic device further comprises a metal connector, the outer core of the coaxial cable being electrically connected to the reference ground by using the metal connector.

13. The wireless communications electronic device according to claim 12, wherein the metal connector is a bent flexible circuit board, and the flexible circuit board comprises a first connection end and a second connection end;

wherein the first connection end is connected to the outer core of the coaxial cable and is disposed at the first surface, and the second connection end is connected to the reference ground and is disposed at the second surface.

14. The wireless communications electronic device according to claim 9, wherein input powers obtained by the radiation elements from the feeder are equal.

15. The wireless communications electronic device according to claim 9, wherein lengths of the at least two power division microstrips are equal.

16. The wireless communications electronic device according to claim 9, wherein the substrate of the wireless communications electronic device is a plastic board configured to fix a display device of the wireless communications electronic device.

17. A wireless communications electronic device, comprising:

an antenna assembly; and a substrate;

wherein the antenna assembly comprises:

a radiation element disposed at a first surface of the substrate;

a feeder electrically connected to the radiation element; and a reference ground disposed at a second surface of the substrate;

wherein the antenna assembly comprises at least two radiation elements;

wherein the feeder comprises a microstrip feeder and at least two power division microstrips, and the number of the power division microstrips is equal to that of the radiation elements;

wherein one end of each of the power division microstrips is connected to a corresponding radiation element, and the other end of the each of the power division microstrips is connected to the microstrip feeder.

18. The wireless communications electronic device according to claim 17, wherein the wireless communications electronic device further comprises a display device, wherein the display device comprises a screen and a substrate; and wherein the reference ground is disposed at a backside of the screen and the substrate is an insulation board fixing the screen.

19. A remote control, comprising:

a remote control body; and a display connected to the remote control body;

wherein the display comprises a screen, a substrate fixing the screen and an antenna assembly installed at the substrate;

wherein the antenna assembly comprises:

a radiation element disposed at a first surface of the substrate;

a feeder electrically connected to the radiation element; and a reference ground disposed at a second surface of the substrate;

wherein the antenna assembly comprises at least two radiation elements;

wherein the feeder comprises a microstrip feeder and at least two power division microstrips, and the number of the power division microstrips is equal to that of the radiation elements;

wherein one end of each of the power division microstrips is connected to a corresponding radiation element, and the other end of the each of the power division microstrips is connected to the microstrip feeder.

* * * * *